US008198790B2

(12) United States Patent
Kameda et al.

(10) Patent No.: US 8,198,790 B2
(45) Date of Patent: Jun. 12, 2012

(54) PLASMA JET IGNITION PLUG

(75) Inventors: Hiroyuki Kameda, Aichi-ken (JP); Yoshikuni Sato, Nagoya (JP); Daisuke Nakano, Kiyosu (JP); Naofumi Yamamura, Nagoya (JP); Daisuke Kasahara, Toyoake (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/076,835

(22) Filed: Mar. 31, 2011

(65) Prior Publication Data

US 2011/0241523 A1 Oct. 6, 2011

(30) Foreign Application Priority Data

Mar. 31, 2010 (JP) ..... 2010-081243
Dec. 15, 2010 (JP) ..... 2010-278903

(51) Int. Cl.
*H01T 13/20* (2006.01)

(52) U.S. Cl. ..... 313/141; 313/139; 313/143

(58) Field of Classification Search ..... 313/118–145; 123/32, 41, 143 R, 146.5 R, 169 P, 260, 280, 123/169 R, 169 EL, 310
See application file for complete search history.

(56) References Cited

FOREIGN PATENT DOCUMENTS

| | | |
|---|---|---|
| JP | 2004-235040 | 8/2004 |
| JP | 2006-294257 | 10/2006 |

*Primary Examiner* — Mariceli Santiago
*Assistant Examiner* — Donald Raleigh
(74) *Attorney, Agent, or Firm* — Kusner & Jaffe

(57) ABSTRACT

A plasma jet ignition plug having high ignition performance and high durability. The plasma jet ignition plug comprises a center electrode wherein at least a front end portion including a front end surface of the center electrode contains an oxide of at least one of the rare earth elements in a total amount of 0.5% by mass to 10% by mass inclusive and tungsten (W) in an amount of 90% by mass or greater, or contains iridium (Ir) in an amount of 0.3% by mass to 3% by mass inclusive and W in an amount of 97% by mass or greater.

11 Claims, 3 Drawing Sheets

Ir CONTENT 90% BY MASS

SEM PHOTO

W DISTRIBUTION MAPPING

Ir DISTRIBUTION MAPPING

Ir CONTENT 5% BY MASS

SEM PHOTO

W DISTRIBUTION MAPPING

Ir DISTRIBUTION MAPPING

PLASMA JET IGNITION PLUG

FIELD OF THE INVENTION

The present invention relates to a plasma jet ignition plug.

BACKGROUND OF THE INVENTION

Conventionally, a spark plug has been used to ignite an air-fuel mixture through spark discharge (may be referred to merely as "discharge") for operation of an engine, such as an automotive internal combustion engine. In recent years, high output and low fuel consumption have been required of internal combustion engines. To fulfill such requirements, development of a plasma jet ignition plug has been conducted, since the plasma jet ignition plug provides quick propagation of combustion and exhibits such high ignition performance as to be capable of reliably igniting even a lean air-fuel mixture having a higher ignition-limit air-fuel ratio.

The plasma jet ignition plug has a structure in which an insulator formed from ceramic or the like surrounds a spark discharge gap between a center electrode and a ground electrode, thereby forming a small-volume discharge space called a cavity. An example system of ignition of the plasma jet ignition plug is described. For ignition of an air-fuel mixture, first, high voltage is applied between the center electrode and the ground electrode, thereby generating spark discharge. By virtue of associated occurrence of dielectric breakdown, current can be applied between the center electrode and the ground electrode with a relatively low voltage. Thus, through transition of a discharge state from the spark discharge effected by further supply of energy, plasma is generated within the cavity. The generated plasma is jetted out through an opening (so-called orifice), thereby igniting the air-fuel mixture. For example, see Japanese Patent Application Laid-Open (kokai) No. 2006-294257 (Patent Document 1).

Meanwhile, the plasma jet ignition plug requires application of high-energy current during discharge. Application of high-energy current involves an increase in erosion of an electrode. Thus, in an attempt to restrain erosion of an electrode, a material having a high melting point is used to form the electrode. For example, see Japanese Patent Application Laid-Open (kokai) No. 2004-235040 (Patent Document 2). However, development of a plasma jet ignition plug which exhibits further restraint of electrode erosion and has high durability is awaited.

SUMMARY OF THE INVENTION

Problems to be Solved by the Invention

An object of the present invention is to provide a plasma jet ignition plug having high ignition performance and high durability.

Means for Solving the Problems

To achieve the above-mentioned object, the present invention provides a plasma jet ignition plug described below in (1).

(1) A plasma jet ignition plug comprises a center electrode; an insulator having an axial hole extending in a direction of an axis, and holding the center electrode which is disposed within the axial hole such that a front end surface of the center electrode exists within the axial hole; a metallic shell holding the insulator; and a ground electrode joined to the metallic shell, disposed frontward of the insulator, and adapted to generate spark discharge in cooperation with the center electrode. In the plasma jet ignition plug, at least a front end portion of the center electrode, which end portion includes the front end surface, contains an oxide of at least one of the rare earth elements in a total amount of 0.5% by mass to 10% by mass inclusive and W in an amount of 90% by mass or greater.

In the plasma jet ignition plug described above in (1), preferably, (2) the oxide of at least one of the rare earth elements is contained in a total amount of 0.5% by mass to 7% by mass inclusive, (3) the center electrode contains an oxide of at least La or Y among rare earth elements in a total amount of 0.5% by mass to 5% by mass inclusive, or (4) the center electrode contains Ir in an amount of 0.3% by mass to 3% by mass inclusive, and the total amount of Ir, W, and the oxide of at least one of the rare earth elements is 100% by mass.

To achieve the above-mentioned object, the present invention further provides a plasma jet ignition plug described below in (5).

(5) A plasma jet ignition plug comprises a center electrode; an insulator having an axial hole extending in a direction of an axis, and holding the center electrode which is disposed within the axial hole such that a front end surface of the center electrode exists within the axial hole; a metallic shell holding the insulator; and a ground electrode joined to the metallic shell, disposed frontward of the insulator, and adapted to generate spark discharge in cooperation with the center electrode. In the plasma jet ignition plug, at least a front end portion of the center electrode, which end portion includes the front end surface, contains Ir in an amount of 0.3% by mass to 3% by mass inclusive and W in an amount of 97% by mass or greater.

In the plasma jet ignition plug described above in (1) or (5), preferably, (6) the ground electrode contains Ir, (7) the ground electrode contains Ir in an amount of 10% by mass or greater, or (8) the ground electrode contains Ir in an amount of 90% by mass or greater.

Effect of the Invention

In the plasma jet ignition plug according to the present invention, at least a front end portion of the center electrode, which end portion includes the front end surface, contains W and an oxide of at least one of the rare earth elements at particular percentages or contains Ir and W at particular percentages. Thus, even though high-energy current is applied for ensuring high ignition performance, the amount of arc-induced erosion of the center electrode can be restrained. As a result, the present invention can provide a plasma jet ignition plug having high ignition performance and high durability.

Also, when the ground electrode contains Ir, the amount of arc-induced erosion of the center electrode can be further restrained.

DETAILED DESCRIPTION OF PREFERRED EMBODIMENTS

A plasma jet ignition plug according to the present invention includes a center electrode; an insulator having an axial hole extending in the axial direction, and holding the center electrode which is disposed within the axial hole such that the front end surface of the center electrode exists within the axial hole; a metallic shell holding the insulator; and a ground electrode joined to the metallic shell, disposed frontward of the insulator, and adapted to generate spark discharge in cooperation with the center electrode. So long as the plasma jet ignition plug according to the present invention has such a configuration, no particular limitation is imposed on other configurational features, and other configurational features can be publicly known ones.

Figure 1:
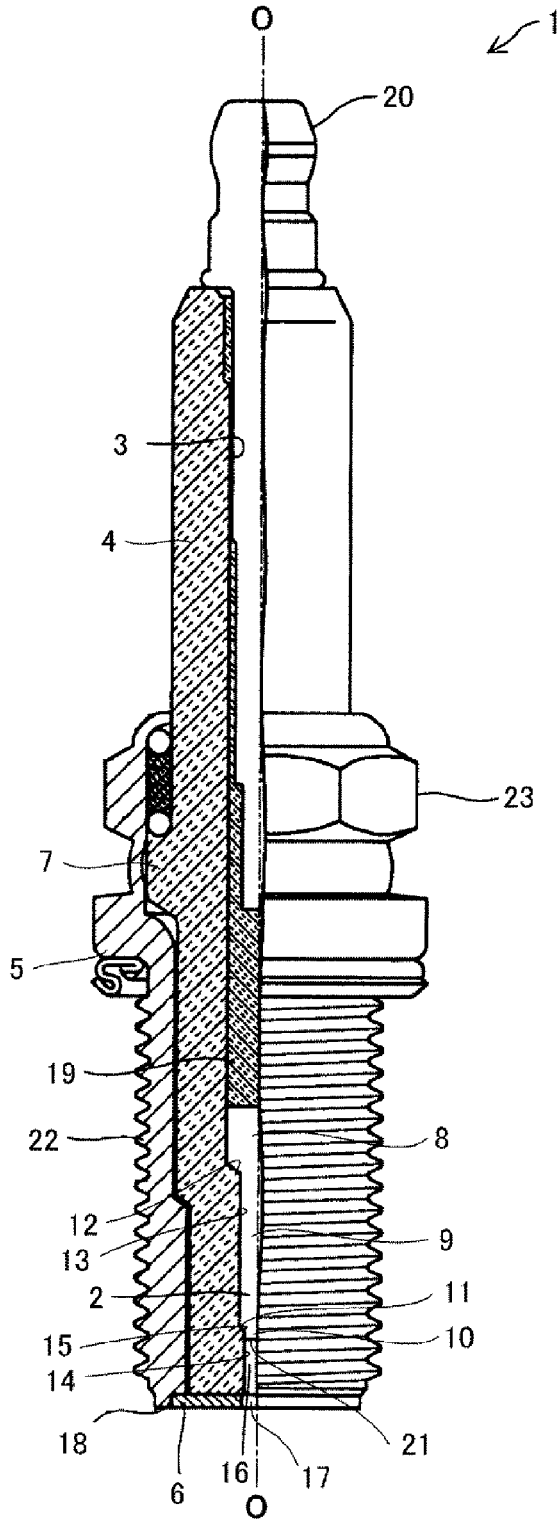
FIG. 1 is a partially sectional view showing the configuration of a plasma jet ignition plug according to an embodiment of the present invention.
Figure 2:
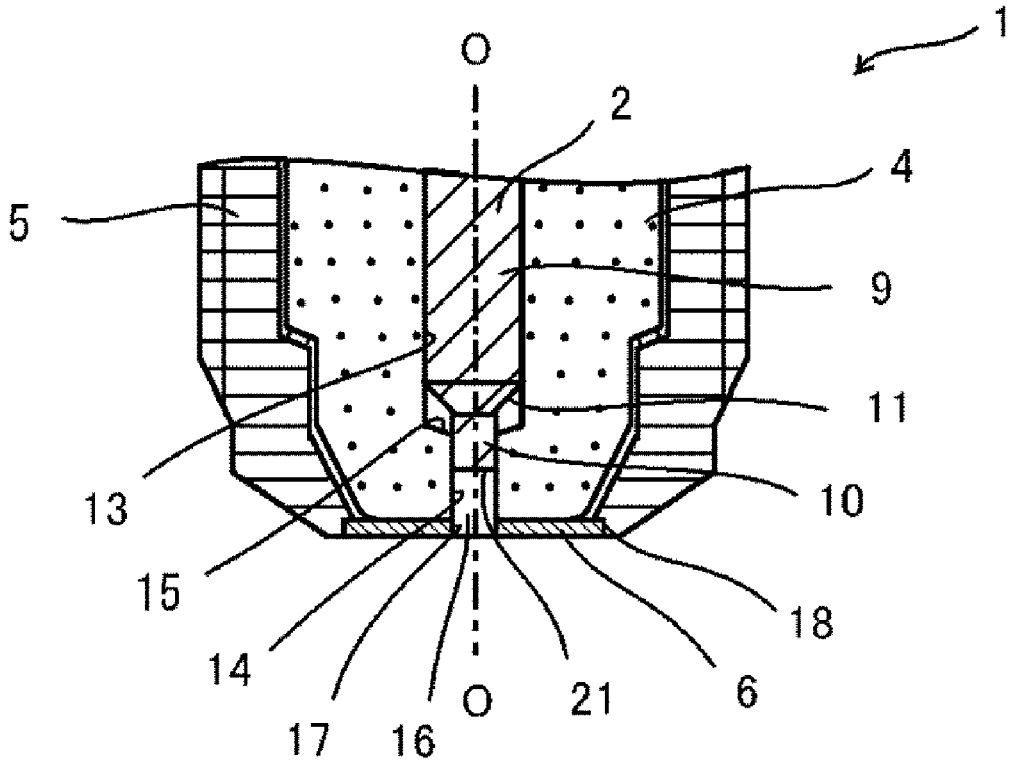
FIG. 2 is a sectional view showing essential portions of the plasma jet ignition plug of FIG. 1.

FIG. 1 shows a plasma jet ignition plug according to an embodiment of the present invention. FIG. 1 shows, partially in section, the configuration of a plasma jet ignition plug 1 according to the embodiment of the present invention. FIG. 2 shows, in section, essential portions of the plasma jet ignition plug 1. In the following description with reference to FIGS. 1 and 2, a downward direction on the paper on which FIG. 1 appears is referred to as a frontward direction along an axis O, and an upward direction on the paper is referred to as a rearward direction along the axis O.

As shown in FIGS. 1 and 2, the plasma jet ignition plug 1 includes a substantially tubular insulator 4 having an axial hole 3 extending in the direction of the axis O, a center electrode 2 accommodated within the axial hole 3 of the insulator 4, a ground electrode 6 disposed on the front end of the insulator 4, a metal terminal 20 provided at a rear end portion of the insulator 4, and a metallic shell 5 which holds the insulator 4.

As well known, the insulator 4 is an insulation member formed from alumina or the like by firing. The insulator 4 has a flange portion 7 which has the largest outside diameter and is located at substantially the center along the direction of the axis O. A portion of the insulator 4 located frontward of the flange portion 7 is intermediately stepped so as to form a front end portion having a further reduced outside diameter.

The center electrode 2 is a substantially circular columnar electrode rod formed such that at least a front end portion 10 including a front end surface 21 is formed of an electrode material having a composition to be described later. The center electrode 2 may have an embedded metal core (not shown) formed of copper or a like material having excellent thermal conductivity. The center electrode 2 includes a trunk portion 8, an intermediate portion 9 located frontward of the trunk portion 8, the front end portion 10 located frontward of the intermediate portion 9, and a tapered portion 11 located between the intermediate portion 9 and the front end portion 10. The intermediate portion 9 is smaller in outside diameter than the trunk portion 8. The front end portion 10 is smaller in outside diameter than the intermediate portion 9. A shoulder-like portion is formed between the trunk portion 8 and the intermediate portion 9. The shoulder-like portion comes into contact with a ledge portion 12 of the axial hole 3 of the insulator 4, thereby positioning the center electrode 2 within the axial hole 3.

A portion of the axial hole 3 of the insulator 4 which is located frontward of the ledge portion 12 is composed of an accommodation portion 13, which accommodates the intermediate portion 9 of the center electrode 2; a small-diameter portion 14, which is located frontward of the accommodation portion 13 and in which the front end portion 10 of the center electrode 2 is disposed; and a stepped portion 15 located between the accommodation portion 13 and the small-diameter portion 14. The inner diameter of the small-diameter portion 14 is smaller than that of the accommodation portion 13. The front end of the center electrode 2 is located rearward of the front end of the insulator 4 within the small-diameter portion 14 of the axial hole 3 of the insulator 4. The front end portion 10, particularly the front end surface 21, of the center electrode 2 and the inner circumferential wall of the small-diameter portion 14 define a discharge space having a small volume. The discharge space is called a cavity 16.

The ground electrode 6 is formed of a metal having excellent resistance to arc-induced erosion; specifically, an electrode material having a composition to be described below, or a publicly known material other than the electrode material. In order to reduce the amount of erosion of the center electrode 2, preferably, the ground electrode 6 is formed of the electrode material to be described below. The ground electrode 6 has a disk-like shape having a thickness of 0.3 mm to 1 mm. The ground electrode 6 has an opening portion 17 at the center for allowing the cavity 16 to communicate with the exterior atmosphere of the cavity 16. While being in contact with the front end of the insulator 4, the ground electrode 6 is engaged with an engagement portion 18 formed on the inner circumferential surface of a front end portion of the metallic shell 5. The outer circumferential edge of the ground electrode 6 is laser-welded along the entire circumference to the engagement portion 18, whereby the ground electrode 6 is joined to the metallic shell 5.

The center electrode 2 is electrically connected to the metal terminal 20, which is located rearward of the center electrode 2, via an electrically conductive seal body 19 formed of a mixture of metal and glass provided in the axial hole 3. By virtue of the seal body 19, the center electrode 2 and the metal terminal 20 are fixed in the axial hole 3 and electrically communicate with each other. A high-voltage cable (not shown) is connected to the metal terminal 20 via a plug cap (not shown).

The metallic shell 5 is a substantially cylindrical metal member for fixing the plasma jet ignition plug 1 to the engine head of an internal combustion engine (not shown). The metallic shell 5 holds the insulator 4 inserted thereinto. The metallic shell 5 includes a tool engagement portion 23, to which a plug wrench (not shown) is fitted, and a threaded portion 22, which is formed on the outer circumferential surface of a portion located frontward of the tool engagement portion 23 and is threadingly engaged with the engine head of the internal combustion engine. The metallic shell 5 can be formed of an electrically conductive steel material; for example, low-carbon steel.

The thus-configured plasma jet ignition plug 1 generates plasma and ignites an air-fuel mixture, for example, as follows. In igniting the air-fuel mixture, first, a high voltage is applied between the center electrode 2 and the ground electrode 6 to generate a spark discharge. By virtue of associated occurrence of dielectric breakdown, current can be applied between the center electrode 2 and the ground electrode 6 with a relatively low voltage. Further, current having a high energy of 30 mJ to 200 mJ is applied between the center electrode 2 and the ground electrode 6 from a power source having an arbitrary output for transition of a discharge state from the spark discharge, thereby generating plasma within the cavity 16. The thus-generated plasma is discharged from the opening portion 17 of the ground electrode 6, thereby igniting the air-fuel mixture.

In the plasma jet ignition plug 1, at least the front end portion 10 including the front end surface 21 of the center electrode 2 has a first composition or a second composition described below.

First Composition

In the center electrode 2, at least the front end portion 10 including the front end surface 21 contains tungsten (W) and an oxide of at least one of rare earth elements such that an oxide of one rare earth element or oxides of two or more rare earth elements are contained in a total amount of 0.5% by mass to 10% by mass inclusive and W is contained in an amount of 90% by mass or greater. This composition is hereinafter called the first composition.

When at least the front end portion 10 (a region extending at least 0.3 mm in the direction of the axis O from the front end surface 21) including the front end surface 21 of the center electrode 2 has the first composition, even though high-energy current is applied between the center electrode and the ground electrode, the amount of arc-induced erosion of the center electrode 2 can be reduced. As a result, while ignition performance is ensured, the durability of the plasma jet ignition plug 1 can be improved.

In a plasma jet ignition plug, as mentioned above, high-energy current is applied at the time of ignition. Since application of high-energy current causes significant erosion of an electrode, the electrode is desirably formed of a material having a high melting point. Since tungsten (W) is higher in melting point than platinum (Pt) and iridium (Ir), tungsten (W) can be considered as a desirable material for the electrode. However, the inventors of the present invention et al. have found that an electrode which contains an oxide(s) of a rare earth element(s) in a particular amount and W exhibits a greater reduction in the amount of arc-induced erosion than does an electrode which contains W in an amount of 100% by mass.

In spite of W having a high melting point, the center electrode which contains W in an amount of 100% by mass exhibits a smaller reduction in the amount of arc-induced erosion than expected. Presumably, this is for the following reason: carbon (C) generated in association with combustion reacts with W in the surface of the electrode to generate WC, and, since WC is likely to fly off from the surface of the electrode, electrode erosion is promoted. Conceivably, when the center electrode contains W as a main component and an oxide(s) of a rare earth element(s) in a particular amount, the generation of WC in the electrode surface is restrained; as a result, the flying-off of WC from the electrode surface is restrained, thereby reducing the amount of electrode erosion.

At least the front end portion 10 including the front end surface 21 of the center electrode 2 has the first composition. When high-energy current is supplied for generating plasma, plasma is formed within the cavity 16. Accordingly, the front end surface 21 of the center electrode 2, which partially defines the cavity 16, has a particularly large amount of erosion. Therefore, the entire center electrode 2 may have the first composition, but it is good practice that at least the front end portion 10 of the center electrode 2, particularly the front end surface 21, which is significant in erosion, has the first composition. In the following description, when the composition of the center electrode 2 is discussed, the case where the center electrode has the first composition encompasses the case where only the front end surface 21 of the center electrode 2 has the first composition and the case where only the front end portion 10 of the center electrode 2 has the first composition.

Oxides of rare earth elements are oxides of Y, La, Ce, Nd, Dy, Er, Yb, Pr, Pm, Sm, Eu, Gd, Tb, Ho, Tm, and Lu. The center electrode 2 preferably contains an oxide of at least one element selected from among Y, La, and Ce, particularly preferably an oxide of at least La or Y.

The center electrode 2 contains an oxide(s) of a rare earth element(s) in a total amount of 0.5% by mass to 10% by mass inclusive, preferably 0.5% by mass to 7% by mass inclusive. In the case where the center electrode 2 contains an oxide of at least La or Y among rare earth elements, preferably, the oxide(s) is contained in a total amount of 0.5% by mass to 5% by mass inclusive.

The center electrode 2 contains W in an amount of 90% by mass or greater. When the W content is less than 90% by mass, the effect of reducing the amount of erosion of the center electrode is not achieved.

The center electrode 2 may contain W in an amount of 90% by mass or greater and an oxide of at least one of rare earth electrodes in an amount of 0.5% by mass to 10% by mass, but may additionally contain Ir. When Ir is contained in an amount of 0.3% by mass to 3% by mass inclusive, the amount of erosion of the center electrode is reduced further effectively.

The center electrode 2 contains W and an oxide of at least one of rare earth elements, as well as Ir as desired. These components are contained within the aforementioned respective ranges of content such that the components and unavoidable impurities are contained in a total amount of 100% by mass. Components other than the above-mentioned components, for example, Fe, Mo, etc., may be contained as a trace amount of unavoidable impurities. Preferably, the content of unavoidable impurities is lower. However, unavoidable impurities may be contained to such an extent as not to interfere with achievement of an object of the present invention. When the total mass of the above-mentioned components is taken as 100 parts by mass, preferably, the mass of a single impurity contained is 0.01 part by mass or less, and the total mass of all impurities contained is 0.05 part by mass or less.

Second Composition

In the center electrode 2, at least the front end portion 10 including the front end surface 21 contains Ir and W such that Ir is contained in an amount of 0.3% by mass to 3% by mass inclusive and W is contained in an amount of 97% by mass or greater. This composition is hereinafter called the second composition.

When at least the front end portion 10 including the front end surface 21 of the center electrode 2 has the second composition, as in the case of the first composition, even though high-energy current is applied between the center electrode and the ground electrode, the amount of arc-induced erosion of the center electrode 2 can be reduced. As a result, while ignition performance is ensured, the durability of the plasma jet ignition plug 1 can be improved.

When the center electrode 2 is formed of an electrode material having the second composition, also by virtue of actions similar to those effected by employment of the first composition, the flying-off of WC from the electrode surface is restrained, thereby reducing the amount of electrode erosion.

The center electrode 2 contains Ir in an amount of 0.3% by mass to 3% by mass inclusive, preferably 0.3% by mass to 1% by mass inclusive. The center electrode 2 contains W in an amount of 97% by mass or greater. When the Ir and W contents fall outside the above-mentioned respective ranges, the effect of reducing the amount of erosion of the center electrode is not achieved.

The center electrode 2 may contain W in an amount of 97% by mass or greater and Ir in an amount of 0.3% by mass to 3% by mass inclusive, but may additionally contain an oxide(s) of a rare earth element(s), such as Y, La, and Ce. When an oxide of at least one of the rare earth elements is contained, the amount of erosion of the center electrode is effectively further reduced.

The center electrode 2 contains Ir and W, as well as an oxide of at least one of the rare earth elements as desired. These components are contained within the aforementioned respective ranges of content such that the components and unavoidable impurities are contained in a total amount of 100% by mass. Components other than the above-mentioned components; for example, Fe, Mo, etc., may be contained as a trace amount of unavoidable impurities. Preferably, the content of such unavoidable impurities is lower. However, unavoidable impurities may be contained to such an extent as not to interfere with achievement of an object of the present invention. When the total mass of the above-mentioned components is taken as 100 parts by mass, preferably, the mass of a single impurity contained is 0.01 part by mass or less, and the total mass of all impurities contained is 0.05 part by mass or less.

Next, an electrode material used to form the ground electrode 6 is described. The ground electrode 6 may be formed of a publicly known electrode material; for example, an Ni-based alloy, such as INCONEL (trade name) 600 or 601. Preferably, the electrode material contains Ir. When the ground electrode 6 contains Ir, the amount of arc-induced erosion of the center electrode 2 can be further reduced.

When the center electrode 2 is formed of a material whose main component is W, as aforementioned, WC is likely to be generated in the surface of the center electrode 2. Presumably, when the ground electrode 6 contains Ir, Ir which has flown off through application of plasma current adheres to the surface of the center electrode; since the melting point of Ir is rather close to that of W, Ir and W are likely to be fused together, thereby forming a fusion layer of Ir and W on the surface of the center electrode 2; and the fusion layer serves as a protection film to restrain the generation of WC, which is likely to fly off from the electrode surface. As a result, the flying-off of WC from the surface of the center electrode 2 is restrained, thereby reducing the amount of electrode erosion.

The Ir content of the ground electrode 6 is preferably 10% by mass or greater, particularly preferably 90% by mass or greater. When the Ir content of the ground electrode 6 falls within the above range, the amount of arc-induced erosion of the center electrode 2 can be further reduced. No particular limitation is imposed on components other than Ir contained in the ground electrode 6. Examples of the components include components of a publicly known electrode material, such as INCONEL 600.

The contents of components of materials used to form the center electrode 2 and the ground electrode 6 can be measured as follows. The facing surfaces of the center electrode 2 and the ground electrode 6 are polished to a roughness of about 0.1 mm. By use of an electron probe micro analyzer (SPMA) (e.g., JXA-8500F from JEOL, Ltd.), the polished surfaces are analyzed under the following conditions: acceleration voltage: 20 kV; beam current: $2.5\times10^{-8}$ mA; and spot diameter: 100 μm to 200 μm. A single sample surface is analyzed at 10 different points. The thus-measured values are averaged, thereby yielding the contents of components of the electrode materials.

In manufacture of the center electrode 2 and the ground electrode 6, predetermined ingredients are mixed at predetermined proportions, and by use of the thus-prepared respective mixtures, the center electrode 2 and the ground electrode 6 are manufactured as described below. The manufactured center electrode 2 and ground electrode 6 have respective compositions which substantially coincide with those of the mixtures. Therefore, according to a simple method, the contents of components of the center electrode 2 and the ground electrode 6 can also be calculated from the mixing proportions of the ingredients.

When the center electrode has the first composition or the second composition, even though high-energy current is applied for ensuring high ignition performance, the amount of arc-induced erosion of the center electrode can be restrained. As a result, a plasma jet ignition plug having high ignition performance and high durability can be provided.

The plasma jet ignition plug 1 is manufactured, for example, as follows. First, an electrode material having the first composition or the second composition is prepared as follows; ingredients selected as appropriate from among W, Ir, and an oxide(s) of a rare earth element(s) are melted together at particular ratios, followed by preparation work. The thus-prepared electrode material is machined into a predetermined shape, thereby forming the center electrode 2. Alternatively, by use of a known electrode material, such as an Ni-based alloy, an electrode rod which will become the center electrode 2 is prepared; in parallel with the preparation of the electrode rod, a disk tip having the first composition or the second composition is prepared; and the prepared tip is, for example, laser-welded to the front end surface of the electrode rod such that the tip is united with the electrode rod.

An electrode material used to form the ground electrode 6 is prepared as follows; a material having a composition similar to that of, for example, INCONEL 600 and a particular amount of Ir are melted together, followed by preparation work. The thus-prepared electrode material is formed into a predetermined shape, thereby forming the ground electrode 6. Meanwhile, the electrode materials can be continuously prepared and worked. For example, by use of a vacuum melting furnace, molten alloys having desired compositions are prepared; ingots are prepared from the molten alloys through vacuum casting; and the ingots are subjected to hot working, wire drawing, etc. for imparting predetermined shapes and predetermined dimensions, thereby yielding the center electrode 2 and the ground electrode 6.

Next, the insulator 4 is formed by firing ceramic or the like in a predetermined shape; the center electrode 2 is assembled to the insulator 4 by a publicly known method; and the resultant insulator 4 is assembled to the metallic shell 5, which is formed into a predetermined shape through plastic working or the like. Then, the ground electrode 6 is fitted to the engagement portion 18 provided on the front end surface of the metallic shell 5, followed by electric resistance welding, laser welding, or the like for joining. In this manner, the plasma jet ignition plug 1 is manufactured.

The plasma jet ignition plug according to the present invention is used as an igniter for an automotive internal combustion engine; for example, a gasoline engine. The plasma jet ignition plug is fixed at a predetermined position such that the threaded portion 22 is threadingly engaged with a threaded hole provided in a head (not shown) which dividingly forms combustion chambers of an internal combustion engine. The plasma jet ignition plug according to the present invention can be used in any type of internal combustion engine, but can be particularly preferably used in an internal combustion engine having high air-fuel ratio, because erosion of the electrodes of the ignition plug can be restrained even when high-energy current is applied thereto.

The plasma jet ignition plug 1 according to the present invention is not limited to the embodiment described above, but may be modified in various other forms, so long as the object of the present invention can be achieved. That is, no particular limitation is imposed on the configuration and shape of the center electrode and the ground electrode, so long as the plasma jet ignition plug generates plasma by a method in which spark discharge is generated through application of high voltage between the center electrode and the ground electrode and the transition of a discharge state from a spark discharge is effected through further supply of energy, or by other methods.

EXAMPLES

Fabrication of Plasma Jet Ignition Plug

By use of an ordinary vacuum melting furnace, molten alloys having the compositions (% by mass) shown in Tables 1 to 9 (shown below) were prepared. From the molten alloys, ingots were prepared through vacuum casting. Subsequently, the ingots were formed into rods through hot casting. The rods were subjected to plastic working, such as extruding, followed by wire drawing, plastic working, etc. for forming wires each having a diameter of 4 mm. From the wires, center electrodes for plasma jet ignition plugs were formed. Also, there were prepared molten alloys which contained Ir in the amounts shown in Tables 4 to 7 and 9 and a balance of Ni, and molten Ni alloys which contained substantially no Ir. The molten alloys were subjected to working in a manner similar to that in formation of the center electrodes, thereby forming disk-like ground electrodes having a center opening portion. The contents of the rare earth elements appearing in the tables are expressed in % by mass as reduced to oxides of the rare earth elements.

By a publicly known method, the center electrodes were assembled to respective insulators formed of ceramic. The resultant insulators were assembled to respective metallic shells. The ground electrodes were joined along full circumference to respective engagement portions provided at front end surfaces of the metallic shells, thereby yielding plasma jet ignition plugs.

The manufactured plasma jet ignition plugs had the following dimensional features: thread diameter: M12; length between front end surface of center electrode and inner surface of ground electrode (length of cavity): 1 mm; inside diameter of front end portion of axial hole of insulator (inside diameter of cavity): 1 mm; and inside diameter of opening portion of ground electrode: 1 mm.

Durability Test Method

The manufactured plasma jet ignition plugs were mounted to a 4-cylinder, 2.0 L engine. The engine was run at an engine speed of 720 rpm for 50 hours or 100 hours. Current having a plasma energy of 80 mJ was applied between the electrodes for generating plasma.

Evaluation of Durability

Case of the Center Electrode Having the First Composition

The durability of the plasma jet ignition plugs whose center electrodes have the compositions shown in Table 1 and whose ground electrodes are formed of an Ni alloy were evaluated as follows. The amount of reduction in volume of the center electrode was obtained by measuring the electrode volume before and after the durability test. The amount of reduction in volume per hour was calculated for use as the amount of erosion. The obtained amount of erosion was evaluated under the following criteria.

Failure: The amount of erosion is larger than that of the center electrode having the reference composition.

Fair: The amount of erosion is greater than ⅔ that of the center electrode having the reference composition and equal to or less than that of the center electrode having the reference composition.

Good: The amount of erosion is greater than ⅓ that of the center electrode having the reference composition and equal to or less than ⅔ that of the center electrode having the reference composition.

Excellent: The amount of erosion is equal to or less than ⅓ that of the center electrode having the reference composition.

TABLE 1

| | | Composition of center electrode (% by mass) | | | | Durability |
|---|---|---|---|---|---|---|
| No. | | W | La | Y | Ce | Run 50 (Hr) |
| Reference composition | | 100.00 | | | | |
| 1 | Comparative Ex. | 99.70 | 0.30 | | | Failure |
| 2 | Example | 99.50 | 0.50 | | | Excellent |
| 3 | | 98.00 | 2.00 | | | Excellent |
| 4 | | 95.00 | 5.00 | | | Excellent |
| 5 | | 93.00 | 7.00 | | | Good |
| 6 | | 90.00 | 10.00 | | | Fair |
| 7 | Comparative Ex. | 88.00 | 12.00 | | | Failure |
| 8 | | 99.70 | | 0.30 | | Failure |
| 9 | Example | 99.50 | | 0.50 | | Excellent |
| 10 | | 98.00 | | 2.00 | | Excellent |
| 11 | | 95.00 | | 5.00 | | Excellent |
| 12 | | 93.00 | | 7.00 | | Good |
| 13 | | 90.00 | | 10.00 | | Fair |
| 14 | Comparative Ex. | 88.00 | | 12.00 | | Failure |
| 15 | | 99.70 | | | 0.30 | Failure |
| 16 | Example | 99.50 | | | 0.50 | Good |
| 17 | | 98.00 | | | 2.00 | Excellent |
| 18 | | 95.00 | | | 5.00 | Excellent |
| 19 | | 93.00 | | | 7.00 | Good |
| 20 | | 90.00 | | | 10.00 | Fair |
| 21 | Comparative Ex. | 88.00 | | | 12.00 | Failure |
| 22 | | 99.70 | 0.15 | 0.15 | | Failure |
| 23 | Example | 99.50 | 0.25 | 0.25 | | Excellent |
| 24 | | 95.00 | 2.50 | 2.50 | | Excellent |
| 25 | | 93.00 | 3.50 | 3.50 | | Excellent |
| 26 | | 90.00 | 5.00 | 5.00 | | Fair |
| 27 | Comparative Ex. | 88.00 | 6.00 | 6.00 | | Failure |
| 28 | | 99.70 | 0.15 | | 0.15 | Failure |
| 29 | Example | 99.50 | 0.25 | | 0.25 | Good |
| 30 | | 99.00 | 0.50 | | 0.50 | Excellent |
| 31 | | 93.00 | 0.50 | | 6.50 | Excellent |
| 32 | | 90.00 | 5.00 | | 5.00 | Fair |
| 33 | Comparative Ex. | 88.00 | 6.00 | | 6.00 | Failure |
| 34 | Example | 99.50 | | 0.25 | 0.25 | Good |
| 35 | | 99.00 | | 0.50 | 0.50 | Excellent |
| 36 | Comparative Ex. | 99.70 | 0.10 | 0.10 | 0.10 | Failure |
| 37 | Example | 99.50 | 0.20 | 0.20 | 0.10 | Good |
| 38 | | 99.30 | 0.25 | 0.25 | 0.20 | Excellent |
| 39 | | 93.00 | 2.50 | 2.50 | 2.00 | Excellent |
| 40 | | 90.00 | 4.00 | 4.00 | 2.00 | Fair |
| 41 | Comparative Ex. | 88.00 | 4.00 | 4.00 | 4.00 | Failure |

The durability of the plasma jet ignition plugs whose center electrodes have the compositions shown in Tables 2 and 3 and whose ground electrodes are formed of an Ni alloy were evaluated as follows. The amount of reduction in volume of the center electrode was obtained by measuring the electrode volume before and after the durability test. The amount of reduction in volume per hour was calculated for use as the amount of erosion. The obtained amount of erosion was evaluated under the following criteria.

Failure: The amount of erosion is equal to or larger than that of the center electrode having the reference composition.

Good: The amount of erosion is smaller than that of the center electrode having the reference composition.

TABLE 2

| No. | | Composition of center electrode (% by mass) W | La | Y | Ce | Ir | Durability Run 50 (Hr) |
|---|---|---|---|---|---|---|---|
| Reference composition | | 99.50 | 0.50 | | | | |
| 42 | Example | 99.30 | 0.50 | | | 0.20 | Failure |
| 43 | | 99.20 | 0.50 | | | 0.30 | Good |
| 44 | | 98.50 | 0.50 | | | 1.00 | Good |
| 45 | | 96.50 | 0.50 | | | 3.00 | Good |
| 46 | | 95.50 | 0.50 | | | 4.00 | Failure |
| Reference composition | | 93.00 | 7.00 | | | | |
| 47 | Example | 92.80 | 7.00 | | | 0.20 | Failure |
| 48 | | 92.70 | 7.00 | | | 0.30 | Good |
| 49 | | 92.00 | 7.00 | | | 1.00 | Good |
| 50 | | 90.00 | 7.00 | | | 3.00 | Good |
| 51 | Comparative Ex. | 89.00 | 7.00 | | | 4.00 | Failure |
| Reference composition | | 99.00 | 10.00 | | | | |
| 52 | Comparative Ex. | 89.70 | 10.00 | | | 0.30 | Failure |
| 53 | | 87.00 | 10.00 | | | 3.00 | Failure |
| Reference composition | | 99.50 | | 0.50 | | | |
| 54 | Example | 99.30 | | 0.50 | | 0.20 | Failure |
| 55 | | 99.20 | | 0.50 | | 0.30 | Good |
| 56 | | 98.50 | | 0.50 | | 1.00 | Good |
| 57 | | 96.50 | | 0.50 | | 3.00 | Good |
| 58 | | 95.50 | | 0.50 | | 4.00 | Failure |
| Reference composition | | 93.00 | | 7.00 | | | |
| 59 | Example | 92.80 | | 7.00 | | 0.20 | Failure |
| 60 | | 92.70 | | 7.00 | | 0.30 | Good |
| 61 | | 92.00 | | 7.00 | | 1.00 | Good |
| 62 | | 90.00 | | 7.00 | | 3.00 | Good |
| 63 | Comparative Ex. | 89.00 | | 7.00 | | 4.00 | Failure |
| Reference composition | | 99.50 | | | 0.50 | | |
| 64 | Example | 99.30 | | | 0.50 | 0.20 | Failure |
| 65 | | 99.20 | | | 0.50 | 0.30 | Good |
| 66 | | 98.50 | | | 0.50 | 1.00 | Good |
| 67 | | 96.50 | | | 0.50 | 3.00 | Good |
| 68 | | 95.50 | | | 0.50 | 4.00 | Failure |
| Reference composition | | 93.00 | | | 7.00 | | |
| 69 | Example | 92.80 | | | 7.00 | 0.20 | Failure |
| 70 | | 92.70 | | | 7.00 | 0.30 | Good |
| 71 | | 92.00 | | | 7.00 | 1.00 | Good |
| 72 | | 90.00 | | | 7.00 | 3.00 | Good |
| 73 | Comparative Ex. | 89.00 | | | 7.00 | 4.00 | Failure |

TABLE 3

| No. | | Composition of center electrode (% by mass) W | La | Y | Ce | Ir | Durability Run 50 (Hr) |
|---|---|---|---|---|---|---|---|
| Reference composition | | 99.50 | 0.25 | 0.25 | | | |
| 74 | Example | 99.30 | 0.25 | 0.25 | | 0.20 | Failure |
| 75 | | 99.20 | 0.25 | 0.25 | | 0.30 | Good |
| 76 | | 98.50 | 0.25 | 0.25 | | 1.00 | Good |
| 77 | | 96.50 | 0.25 | 0.25 | | 3.00 | Good |
| 78 | | 95.50 | 0.25 | 0.25 | | 4.00 | Failure |
| Reference composition | | 99.50 | 0.25 | | 0.25 | | |
| 79 | Example | 99.30 | 0.25 | | 0.25 | 0.20 | Failure |
| 80 | | 99.20 | 0.25 | | 0.25 | 0.30 | Good |
| 81 | | 98.50 | 0.25 | | 0.25 | 1.00 | Good |
| 82 | | 96.50 | 0.25 | | 0.25 | 3.00 | Good |
| 83 | | 95.50 | 0.25 | | 0.25 | 4.00 | Failure |
| Reference composition | | 95.00 | 2.50 | | 2.50 | | |
| 84 | Example | 94.80 | 2.50 | | 2.50 | 0.20 | Failure |
| 85 | | 94.70 | 2.50 | | 2.50 | 0.30 | Good |
| 86 | | 94.00 | 2.50 | | 2.50 | 1.00 | Good |
| 87 | | 92.00 | 2.50 | | 2.50 | 3.00 | Good |
| 88 | | 91.00 | 2.50 | | 2.50 | 4.00 | Failure |
| Reference composition | | 99.50 | | 0.25 | 0.25 | | |

TABLE 3-continued

| No. | | Composition of center electrode (% by mass) W | La | Y | Ce | Ir | Durability Run 50 (Hr) |
|---|---|---|---|---|---|---|---|
| 89 | Example | 99.30 | | 0.25 | 0.25 | 0.20 | Failure |
| 90 | | 99.20 | | 0.25 | 0.25 | 0.30 | Good |
| 91 | | 98.50 | | 0.25 | 0.25 | 1.00 | Good |
| 92 | | 96.50 | | 0.25 | 0.25 | 3.00 | Good |
| 93 | | 95.50 | | 0.25 | 0.25 | 4.00 | Failure |
| Reference composition | | 95.00 | | 2.50 | 2.50 | | |
| 94 | Example | 94.80 | | 2.50 | 2.50 | 0.20 | Failure |
| 95 | | 94.70 | | 2.50 | 2.50 | 0.30 | Good |
| 96 | | 94.00 | | 2.50 | 2.50 | 1.00 | Good |
| 97 | | 92.00 | | 2.50 | 2.50 | 3.00 | Good |
| 98 | | 91.00 | | 2.50 | 2.50 | 4.00 | Failure |
| Reference composition | | 99.70 | 0.10 | 0.10 | 0.10 | | |
| 99 | Comparative Ex. | 99.50 | 0.10 | 0.10 | 0.10 | 0.20 | Failure |
| 100 | | 99.40 | 0.10 | 0.10 | 0.10 | 0.30 | Good |
| 101 | | 98.70 | 0.10 | 0.10 | 0.10 | 1.00 | Good |
| 102 | | 96.70 | 0.10 | 0.10 | 0.10 | 3.00 | Good |
| 103 | | 95.70 | 0.10 | 0.10 | 0.10 | 4.00 | Failure |
| Reference composition | | 94.00 | 2.00 | 2.00 | 2.00 | | |
| 104 | Example | 93.80 | 2.00 | 2.00 | 2.00 | 0.20 | Failure |
| 105 | | 93.70 | 2.00 | 2.00 | 2.00 | 0.30 | Good |
| 106 | | 93.00 | 2.00 | 2.00 | 2.00 | 1.00 | Good |
| 107 | | 91.00 | 2.00 | 2.00 | 2.00 | 3.00 | Good |
| 108 | | 90.00 | 2.00 | 2.00 | 2.00 | 4.00 | Failure |

Case of the Center Electrode Having the First Composition and the Ground Electrode Containing Ir The durability of the plasma jet ignition plugs whose center electrodes and ground electrodes have the compositions shown in Tables 4 to 7 were evaluated as follows. The amount of reduction in volume of the center electrode was obtained by measuring the electrode volume before and after the durability test. The amount of reduction in volume per hour was calculated for use as the amount of erosion. The obtained amount of erosion was evaluated under the following criteria.

Failure: The percentage of a reduction in the amount of erosion to the amount of erosion of the center electrode having the reference composition is less than 25%.

Fair: The percentage of a reduction in the amount of erosion to the amount of erosion of the center electrode having the reference composition is 25% to less than 50%.

Good: The percentage of a reduction in the amount of erosion to the amount of erosion of the center electrode having the reference composition is 50% or greater.

TABLE 4

| No. | | Center electrode Composition (% by mass) W | La | Y | Ce | Ground electrode Content (% by mass) Ir | Run time (Hr) 50 | 100 |
|---|---|---|---|---|---|---|---|---|
| | Reference composition | 100.00 | | | | 0.00 | | |
| 109 | Comparative Example | 100.00 | | | | 5.00 | Failure | Failure |
| 110 | | | | | | 10.00 | Failure | Failure |
| 111 | | | | | | 50.00 | Failure | Failure |
| 112 | | | | | | 85.00 | Failure | Failure |
| 113 | | | | | | 90.00 | Failure | Failure |
| 114 | | | | | | 100.00 | Failure | Failure |
| 1 | Reference composition | 99.70 | 0.30 | | | 0.00 | | |
| 115 | Comparative Example | 99.70 | 0.30 | | | 5.00 | Failure | Failure |
| 116 | | | | | | 100.00 | Failure | Failure |
| 2 | Reference composition | 99.50 | 0.50 | | | 0.00 | | |
| 117 | Example | 99.50 | 0.50 | | | 5.00 | Failure | Failure |
| 118 | | | | | | 10.00 | Good | Failure |
| 119 | | | | | | 50.00 | Good | Fair |
| 120 | | | | | | 85.00 | Good | Fair |
| 121 | | | | | | 90.00 | Good | Good |
| 122 | | | | | | 100.00 | Good | Good |
| 6 | Reference composition | 90.00 | 10.00 | | | 0.00 | | |
| 123 | Example | 90.00 | 10.00 | | | 5.00 | Failure | Failure |
| 124 | | | | | | 10.00 | Good | Failure |
| 125 | | | | | | 50.00 | Good | Fair |
| 126 | | | | | | 85.00 | Good | Fair |
| 127 | | | | | | 90.00 | Good | Good |
| 128 | | | | | | 100.00 | Good | Good |
| 7 | Reference composition | 88.00 | 12.00 | | | 0.00 | | |
| 129 | Comparative Example | 88.00 | 12.00 | | | 5.00 | Failure | Failure |
| 130 | | | | | | 100.00 | Failure | Failure |
| 13 | Reference composition | 90.00 | | 10.00 | | 0.00 | | |
| 131 | Example | 90.00 | | 10.00 | | 5.00 | Failure | Failure |
| 132 | | | | | | 10.00 | Good | Failure |
| 133 | | | | | | 50.00 | Good | Fair |
| 134 | | | | | | 85.00 | Good | Fair |
| 135 | | | | | | 90.00 | Good | Good |
| 136 | | | | | | 100.00 | Good | Good |
| 20 | Reference composition | 90.00 | | | 10.00 | 0.00 | | |
| 137 | Example | 90.00 | | | 10.00 | 5.00 | Failure | Failure |
| 138 | | | | | | 10.00 | Good | Failure |
| 139 | | | | | | 50.00 | Good | Fair |
| 140 | | | | | | 85.00 | Good | Fair |
| 141 | | | | | | 90.00 | Good | Good |
| 142 | | | | | | 100.00 | Good | Good |

TABLE 5

| No. | | Center electrode Composition (% by mass) W | La | Y | Ce | Ground electrode Content (% by mass) Ir | Run time (Hr) 50 | 100 |
|---|---|---|---|---|---|---|---|---|
| 26 | Reference composition | 90.00 | 5.00 | 5.00 | | 0.00 | | |
| 143 | Example | 90.00 | 5.00 | 5.00 | | 5.00 | Failure | Failure |
| 144 | | | | | | 10.00 | Good | Failure |
| 145 | | | | | | 50.00 | Good | Fair |
| 146 | | | | | | 85.00 | Good | Fair |
| 147 | | | | | | 90.00 | Good | Good |
| 148 | | | | | | 100.00 | Good | Good |
| 32 | Reference composition | 90.00 | 5.00 | | 5.00 | 0.00 | | |
| 149 | Example | 90.00 | 5.00 | | 5.00 | 5.00 | Failure | Failure |
| 150 | | | | | | 10.00 | Good | Failure |
| 151 | | | | | | 50.00 | Good | Fair |
| 152 | | | | | | 85.00 | Good | Fair |
| 153 | | | | | | 90.00 | Good | Good |
| 154 | | | | | | 100.00 | Good | Good |
| 34 | Reference composition | 99.50 | | 0.25 | 0.25 | 0.00 | | |

TABLE 5-continued

| No. | | Center electrode Composition (% by mass) W | La | Y | Ce | Ground electrode Content (% by mass) Ir | Run time (Hr) 50 | 100 |
|---|---|---|---|---|---|---|---|---|
| 155 | Example | 99.50 | | 0.25 | 0.25 | 5.00 | Failure | Failure |
| 156 | | | | | | 10.00 | Good | Failure |
| 157 | | | | | | 50.00 | Good | Fair |
| 158 | | | | | | 85.00 | Good | Fair |
| 159 | | | | | | 90.00 | Good | Good |
| 160 | | | | | | 100.00 | Good | Good |
| 40 | Reference composition | 90.00 | 4.00 | 4.00 | 2.00 | 0.00 | | |
| 161 | Example | 90.00 | 4.00 | 4.00 | 2.00 | 5.00 | Failure | Failure |
| 162 | | | | | | 10.00 | Good | Failure |
| 163 | | | | | | 50.00 | Good | Fair |
| 164 | | | | | | 85.00 | Good | Fair |
| 165 | | | | | | 90.00 | Good | Good |
| 166 | | | | | | 100.00 | Good | Good |

TABLE 6

| No. | | Center electrode Composition (% by mass) W | La | Y | Ce | Ir | Ground electrode Content (% by mass) Ir | Run time (Hr) 50 | 100 |
|---|---|---|---|---|---|---|---|---|---|
| 42 | Reference composition | 99.30 | 0.50 | | | 0.20 | 0.00 | | |
| 173 | Example | 99.30 | 0.50 | | | 0.20 | 5.00 | Failure | Failure |
| 174 | | | | | | | 10.00 | Good | Failure |
| 175 | | | | | | | 50.00 | Good | Fair |
| 176 | | | | | | | 85.00 | Good | Fair |
| 177 | | | | | | | 90.00 | Good | Good |
| 178 | | | | | | | 100.00 | Good | Good |
| 43 | Reference composition | 99.20 | 0.50 | | | 0.30 | 0.00 | | |
| 179 | Example | 99.20 | 0.50 | | | 0.30 | 5.00 | Failure | Failure |
| 180 | | | | | | | 10.00 | Good | Failure |
| 181 | | | | | | | 50.00 | Good | Fair |
| 182 | | | | | | | 85.00 | Good | Fair |
| 183 | | | | | | | 90.00 | Good | Good |
| 184 | | | | | | | 100.00 | Good | Good |
| 54 | Reference composition | 99.30 | | 0.50 | | 0.20 | 0.00 | | |
| 185 | Example | 99.30 | | 0.50 | | 0.20 | 5.00 | Failure | Failure |
| 186 | | | | | | | 10.00 | Good | Failure |
| 187 | | | | | | | 50.00 | Good | Fair |
| 188 | | | | | | | 85.00 | Good | Fair |
| 189 | | | | | | | 90.00 | Good | Good |
| 190 | | | | | | | 100.00 | Good | Good |
| 64 | Reference composition | 99.30 | | | 0.50 | 0.20 | 0.00 | | |
| 191 | Example | 99.30 | | | 0.50 | 0.20 | 5.00 | Failure | Failure |
| 192 | | | | | | | 10.00 | Good | Failure |
| 193 | | | | | | | 50.00 | Good | Fair |
| 194 | | | | | | | 85.00 | Good | Fair |
| 195 | | | | | | | 90.00 | Good | Good |
| 196 | | | | | | | 100.00 | Good | Good |

TABLE 7

| No. | | Center electrode Composition (% by mass) W | La | Y | Ce | Ir | Ground electrode Content (% by mass) Ir | Run time (Hr) 50 | 100 |
|---|---|---|---|---|---|---|---|---|---|
| 74 | Reference composition | 99.30 | 0.25 | 0.25 | | 0.20 | 0.00 | | |
| 197 | Example | 99.30 | 0.25 | 0.25 | | 0.20 | 5.00 | Failure | Failure |
| 198 | | | | | | | 10.00 | Good | Failure |
| 199 | | | | | | | 50.00 | Good | Fair |
| 200 | | | | | | | 85.00 | Good | Fair |
| 201 | | | | | | | 90.00 | Good | Good |
| 202 | | | | | | | 100.00 | Good | Good |
| 79 | Reference composition | 99.30 | 0.25 | | 0.25 | 0.20 | 0.00 | | |
| 203 | Example | 99.30 | 0.25 | | 0.25 | 0.20 | 5.00 | Failure | Failure |
| 204 | | | | | | | 10.00 | Good | Failure |
| 205 | | | | | | | 50.00 | Good | Fair |
| 206 | | | | | | | 85.00 | Good | Fair |
| 207 | | | | | | | 90.00 | Good | Good |
| 208 | | | | | | | 100.00 | Good | Good |
| 89 | Reference composition | 99.30 | | 0.25 | 0.25 | 0.20 | | | |
| 209 | Example | 99.30 | | 0.25 | 0.25 | 0.20 | 5.00 | Failure | Failure |
| 210 | | | | | | | 10.00 | Good | Failure |
| 211 | | | | | | | 50.00 | Good | Fair |
| 212 | | | | | | | 85.00 | Good | Fair |
| 213 | | | | | | | 90.00 | Good | Good |
| 214 | | | | | | | 100.00 | Good | Good |
| 99 | Reference composition | 99.50 | 0.10 | 0.10 | 0.10 | 0.20 | | | |
| 215 | Comparative Example | 99.50 | 0.10 | 0.10 | 0.10 | 0.20 | 5.00 | Failure | Failure |
| 216 | | | | | | | 10.00 | Failure | Failure |
| 217 | | | | | | | 50.00 | Failure | Failure |
| 218 | | | | | | | 85.00 | Failure | Failure |
| 219 | | | | | | | 90.00 | Failure | Failure |
| 220 | | | | | | | 100.00 | Failure | Failure |
| 104 | Reference composition | 93.80 | 2.00 | 2.00 | 2.00 | 0.20 | | | |
| 221 | Example | 93.80 | 2.00 | 2.00 | 2.00 | 0.20 | 5.00 | Failure | Failure |
| 222 | | | | | | | 10.00 | Good | Failure |
| 223 | | | | | | | 50.00 | Good | Fair |
| 224 | | | | | | | 85.00 | Good | Fair |
| 225 | | | | | | | 90.00 | Good | Good |
| 226 | | | | | | | 100.00 | Good | Good |

Case of the Center Electrode Having the Second Composition

The durability of the plasma jet ignition plugs whose center electrodes have the compositions shown in Table 8 and whose ground electrodes are formed of an Ni alloy were evaluated as in the case of the plasma jet ignition plugs of Table 1.

TABLE 8

| No | | Composition of center electrode (% by mass) W | Ir | Durability Run 50 (Hr) |
|---|---|---|---|---|
| | Reference composition | 100.00 | | |
| 227 | Comparative Example | 99.80 | 0.20 | Failure |
| 228 | Example | 99.70 | 0.30 | Good |
| 229 | | 99.50 | 0.50 | Excellent |
| 230 | | 99.00 | 1.00 | Excellent |
| 231 | | 97.00 | 3.00 | Fair |
| 232 | Comparative Example | 96.00 | 4.00 | Failure |

Case of the Center Electrode Having the Second Composition and the Ground Electrode Containing Ir The durability of the plasma jet ignition plugs whose center electrodes and ground electrodes have the compositions shown in Table 9 were evaluated as in the case of the plasma jet ignition plugs of Table 4.

TABLE 9

| Center electrode | Ground electrode Content (% by |
|---|---|

| No. | | Composition (% by mass) W | La | Y | Ce | Ir | mass) Ir | Run time (Hr) 50 | 100 |
|---|---|---|---|---|---|---|---|---|---|
| 227 | Reference composition | 99.80 | | | | 0.20 | 0.00 | | |
| 233 | Comparative Example | 99.80 | | | | 0.20 | 5.00 | Failure | Failure |
| 234 | | | | | | | 10.00 | Failure | Failure |
| 235 | | | | | | | 50.00 | Failure | Failure |
| 236 | | | | | | | 85.00 | Failure | Failure |
| 237 | | | | | | | 90.00 | Failure | Failure |
| 238 | | | | | | | 100.00 | Failure | Failure |
| 231 | Reference composition | 97.00 | | | | 3.00 | 0.00 | | |
| 239 | Example | 97.00 | | | | 3.00 | 5.00 | Failure | Failure |
| 240 | | | | | | | 10.00 | Good | Failure |
| 241 | | | | | | | 50.00 | Good | Fair |
| 242 | | | | | | | 85.00 | Good | Fair |
| 243 | | | | | | | 90.00 | Good | Good |
| 244 | | | | | | | 100.00 | Good | Good |
| 43 | Reference composition | 99.20 | 0.50 | | | 0.30 | 0.00 | | |
| 179 | Example | 99.20 | 0.50 | | | 0.30 | 5.00 | Failure | Failure |
| 180 | | | | | | | 10.00 | Good | Failure |
| 181 | | | | | | | 50.00 | Good | Fair |
| 182 | | | | | | | 85.00 | Good | Fair |
| 183 | | | | | | | 90.00 | Good | Good |
| 184 | | | | | | | 100.00 | Good | Good |
| 100 | Reference composition | 99.40 | 0.10 | 0.10 | 0.10 | 0.30 | 0.00 | | |
| 245 | Example | 99.40 | 0.10 | 0.10 | 0.10 | 0.30 | 5.00 | Failure | Failure |
| 246 | | | | | | | 10.00 | Good | Failure |
| 247 | | | | | | | 50.00 | Good | Fair |
| 248 | | | | | | | 85.00 | Good | Fair |
| 249 | | | | | | | 90.00 | Good | Good |
| 250 | | | | | | | 100.00 | Good | Good |

As shown in Tables 1 to 9, the plasma jet ignition plugs whose center electrodes have compositions which fall within the ranges of the present invention can restrain the amounts of erosion of their center electrodes.

By contrast, as shown in Tables 1 to 8, the plasma jet ignition plugs whose center electrodes have compositions which fall outside the ranges of the present invention fail to reduce the amounts of erosion of their center electrodes to less than the amount of erosion of the center electrode which contains W in an amount of 100% by mass.

In the Comparative Examples of Table 1, the content of an oxide(s) of a rare earth element(s) and/or the content of W fall outside the respective ranges of the present invention; in the Comparative Examples of Table 8, the Ir content and/or the W content fall outside the respective ranges of the present invention; and these Comparative Examples fail to reduce the amounts of erosion of their center electrodes to less than the amount of erosion of the center electrode which contains W in an amount of 100% by mass. As shown in Tables 2 and 3, when the center electrode contains W and an oxide(s) of a rare earth element(s), as well as It in a particular amount, the amount of erosion of the center electrode can be further reduced.

As shown in Tables 4 to 7 and 9, by means of their ground electrodes containing Ir, the plasma jet ignition plugs whose center electrodes have the compositions which fall within the ranges of the present invention can further reduce the amounts of erosion of their center electrodes.

Surface Analysis of Center Electrode

The plasma jet ignition plugs whose center electrodes and ground electrodes have the compositions of sample Nos. 121 and 117 were tested under the same conditions as those of the durability test. Subsequently, the front end portions of the center electrodes were cut along the axial direction. The cut surfaces were analyzed by use of the electron probe micro analyzer (EPMA) (JXA-8500F from JEOL, Ltd.) under the following conditions: acceleration voltage 20: kV; beam current: $2.5\times10^{-6}$ mA; and spot diameter: 100 μm to 200 μm. The test results are shown in FIGS. 3 and 4.

Figure 3:
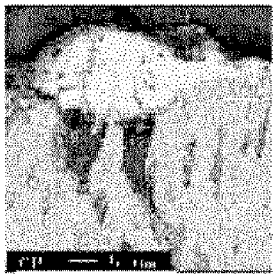
FIG. 3 illustrates photos showing the results of surface analysis of the center electrode of a plasma jet ignition plug whose ground electrode contains Ir in an amount of 90% by mass.
Figure 3:
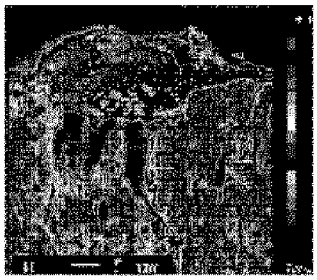
Figure 3:
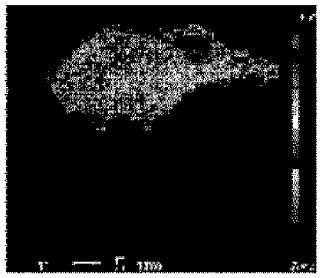
Figure 4:
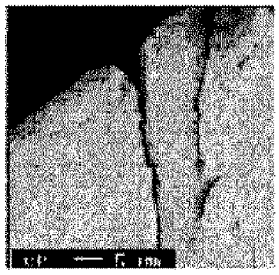
FIG. 4 illustrates photos showing the results of surface analysis of the center electrode of a plasma jet ignition plug whose ground electrode contains Ir in an amount of 5% by mass.
Figure 4:
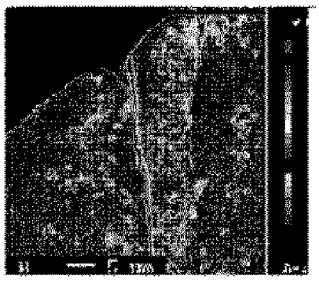
Figure 4:
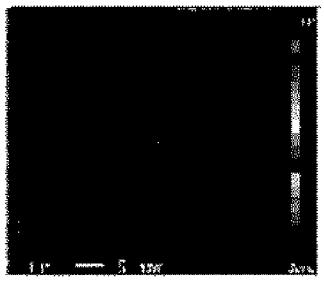

FIG. 3 shows the results of surface analysis of the center electrode of the plasma jet ignition plug whose ground electrode contains Ir in an amount of 90% by mass. FIG. 4 shows the results of surface analysis of the center electrode of the plasma jet ignition plug whose ground electrode contains Ir in an amount of 5% by mass. As shown in FIG. 3, Ir is detected from the front end portion of the center electrode of the plasma jet ignition plug whose ground electrode contains Ir in an amount of 90% by mass. As conceived from the test results, a fusion layer of a W—Ir alloy is formed on the front end portion of the center electrode and functions as a protection film, thereby restraining the flying-off of W from the electrode surface. As shown in FIG. 4, in the case of the plasma jet ignition plug whose ground electrode contains Ir in an amount of 5% by mass, Ir is not detected from the front end portion of the center electrode. This indicates that a fusion layer of a W—Ir alloy is not formed on the front end portion of the center electrode.

DESCRIPTION OF REFERENCE NUMERALS

1: plasma jet ignition plug
2: center electrode
3: axial hole
4: insulator
5: metallic shell
6: ground electrode
7: flange portion
8: trunk portion
9: intermediate portion
10: front end portion
11: tapered portion
12: ledge portion
13: accommodation portion
14: small-diameter portion
15: stepped portion

16: cavity
17: opening portion
18: engagement portion
19: seal body
20: metal terminal
21: front end surface
22: threaded portion
23: tool engagement portion Having described the invention, the following is claimed:

1. A plasma jet ignition plug comprising:

a center electrode;

an insulator having an axial hole extending in a direction of an axis, and holding the center electrode which is disposed within the axial hole such that a front end surface of the center electrode exists within the axial hole;

a metallic shell holding the insulator; and a ground electrode joined to the metallic shell, disposed frontward of the insulator, and adapted to generate spark discharge in cooperation with the center electrode;

wherein at least a front end portion of the center electrode, which end portion includes the front end surface, contains an oxide of at least one of rare earth elements in a total amount of 0.5% by mass to 10% by mass inclusive and W in an amount of 90% by mass or greater.

2. A plasma jet ignition plug according to claim 1, wherein the oxide of at least one of rare earth elements is contained in a total amount of 0.5% by mass to 7% by mass inclusive.

3. A plasma jet ignition plug according to claim 1, wherein the center electrode contains an oxide of at least La or Y among rare earth elements in a total amount of 0.5% by mass to 5% by mass inclusive.

4. A plasma jet ignition plug according to claim 1, wherein the center electrode contains Ir in an amount of 0.3% by mass to 3% by mass inclusive, and the total amount of Ir, W, and the oxide of at least one of rare earth elements is 100% by mass.

5. A plasma jet ignition plug according to claim 1, wherein the ground electrode contains Ir.

6. A plasma jet ignition plug according to claim 1, wherein the ground electrode contains Ir in an amount of 10% by mass or greater.

7. A plasma jet ignition plug according to claim 1, wherein the ground electrode contains Ir in an amount of 90% by mass or greater.

8. A plasma jet ignition plug comprising:

a center electrode;

an insulator having an axial hole extending in a direction of an axis, and holding the center electrode which is disposed within the axial hole such that a front end surface of the center electrode exists within the axial hole;

a metallic shell holding the insulator; and a ground electrode joined to the metallic shell, disposed frontward of the insulator, and adapted to generate spark discharge in cooperation with the center electrode;

wherein at least a front end portion of the center electrode, which end portion includes the front end surface, contains Ir in an amount of 0.3% by mass to 3% by mass inclusive and W in an amount of 97% by mass or greater.

9. A plasma jet ignition plug according to claim 5, wherein the ground electrode contains Ir.

10. A plasma jet ignition plug according to claim 5, wherein the ground electrode contains Ir in an amount of 10% by mass or greater.

11. A plasma jet ignition plug according to claim 5, wherein the ground electrode contains Ir in an amount of 90% by mass or greater.

* * * * *